US008020526B2

(12) United States Patent
Rauch et al.

(10) Patent No.: US 8,020,526 B2
(45) Date of Patent: Sep. 20, 2011

(54) HYDRAULIC UNIT FOR A CYLINDER HEAD OF AN INTERNAL COMBUSTION ENGINE WITH HYDRAULIC, VARIABLE VALVE TRAIN

(75) Inventors: Martin Rauch, Bamberg (DE); Markus Proschko, Baudenbach (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 388 days.

(21) Appl. No.: 12/271,031

(22) Filed: Nov. 14, 2008

(65) Prior Publication Data

US 2009/0120389 A1 May 14, 2009

(30) Foreign Application Priority Data

Nov. 14, 2007 (DE) ..... 10 2007 054 376

(51) Int. Cl.
*F01L 9/02* (2006.01)

(52) U.S. Cl. ..... 123/90.12; 123/90.15; 123/90.16

(58) Field of Classification Search ..... 123/90.11, 123/90.12, 90.15, 90.16
See application file for complete search history.

(56) References Cited

U.S. PATENT DOCUMENTS 6,591,795 B2 * 7/2003 Janak ..... 123/90.12

FOREIGN PATENT DOCUMENTS

DE 102006008676 8/2007

* cited by examiner

*Primary Examiner* — Zelalem Eshete
(74) *Attorney, Agent, or Firm* — Volpe And Koenig, P.C.

(57) ABSTRACT

A hydraulic unit (5) for a cylinder head (2) of an internal combustion engine with a hydraulic, variable valve train (1) is provided. In the hydraulic unit, a high-pressure chamber (11), a medium-pressure chamber (12), and also a low-pressure chamber (16) used as a hydraulic medium reservoir are formed. The low-pressure chamber communicates merely via a choke opening (17) with the medium-pressure chamber, wherein the choke opening passes through a separating wall (18) extending between the low-pressure chamber and the medium-pressure chamber.

8 Claims, 3 Drawing Sheets

HYDRAULIC UNIT FOR A CYLINDER HEAD OF AN INTERNAL COMBUSTION ENGINE WITH HYDRAULIC, VARIABLE VALVE TRAIN

CROSS-REFERENCE TO RELATED APPLICATIONS

This application claims the benefit of DE 10 2007 054 376.1, filed Nov. 14, 2007, which is incorporated herein by reference as if fully set forth.

BACKGROUND

The invention relates to a hydraulic unit for a cylinder head of an internal combustion engine with a hydraulic, variable valve train that comprises

- at least one drive-side master unit,
- at least one driven-side slave unit activating a gas-exchange valve,
- at least one controllable hydraulic valve,
- at least one medium-pressure chamber,
- at least one high-pressure chamber that is arranged in the sense of transmission between the associated master unit and the associated slave unit and can be connected to the associated medium-pressure chamber via the associated hydraulic valve, and
- a hydraulic housing with a housing bottom part and a housing top part, wherein at least the master unit, the slave unit, the high-pressure chamber, the hydraulic valve, and the medium-pressure chamber in connection with the hydraulic housing belong to the hydraulic unit that can be mounted on the cylinder head.

Such a hydraulic unit is known from DE 10 2006 008 676 A1 that is considered a class-forming patent. In the hydraulic unit provided there, all essential components required for the hydraulic, variable transmission of raised sections of a cam to the gas-exchange valves are combined into a common hydraulic housing. This is assembled from a housing bottom part in which the components named above are housed and in which the compression chambers extend and a housing top part closing the housing bottom part. The housing bottom part has a very compact construction and the housing top part also involves an essentially flat plate, so that, overall, each of the medium-pressure chambers is limited to a correspondingly small volume.

However, a small-volume medium-pressure chamber can be problematic during the startup process of the internal combustion engine, in particular, for a startup process at low outside temperatures and after a long standstill of the internal combustion engine. This is based on the fact that the hydraulic medium supply of the internal combustion engine still does not deliver sufficient hydraulic medium flow into the medium-pressure chamber during the startup process and only the hydraulic medium volume remaining in the medium-pressure chamber and also contracted at low temperatures is insufficiently large for a complete refilling of a then expanding high-pressure chamber. This problem applies to an increased extent for startup processes that are repeated in a short time sequence, because, in this case, the hydraulic medium consumption from the medium-pressure chamber can be greater than the volume fed back from the hydraulic medium supply of the internal combustion engine. Such multiple startup processes are typical, for example, for taxi vehicles at taxi stands.

Starting from the publication cited above, this problem can also be eased to only a limited extent by expanding the medium-pressure chamber in the direction of the housing top part then equipped with corresponding cavities, because in this case the formation of gas bubbles in the medium-pressure chamber and their intake into the expanding high-pressure chamber was not reliably ruled out.

SUMMARY

The present invention is therefore based on the objective of improving a hydraulic unit of the type noted above in such a way that the mentioned disadvantages are overcome with simple means. Consequently, for a compact hydraulic housing with corresponding, volume-limited medium-pressure chamber, a secure and complete refilling of the high-pressure chamber expanding during the startup process of the internal combustion engine with hydraulic medium should be achieved.

According to the invention, it is provided that, in the housing top part, a low-pressure chamber is formed acting as a hydraulic medium reservoir, wherein the low-pressure chamber communicates with the medium-pressure chamber merely via at least one choke opening and wherein the choke opening passes through a separating wall extending between the low-pressure chamber and the medium-pressure chamber.

Through the low-pressure chamber extending in the housing top part, first, the hydraulic medium reservoir for the high-pressure chamber required during the startup process of the internal combustion engine expands and, second, the risk of the intake of gas bubbles mentioned above is eliminated to a large degree.

The latter is produced by the separating wall that separates the low-pressure chamber and the medium-pressure chamber, so that during the standstill phase of the internal combustion engine and here cooling and consequently contracting hydraulic medium, the formation of gas bubbles in the medium-pressure chamber is prevented by the feeding of hydraulic medium from the low-pressure chamber.

Furthermore, in the case of an installation of the hydraulic unit inclined to the force of gravity in the internal combustion engine and/or the hydraulic unit, it is provided with the internal combustion engine such that the choke opening runs at a geodetic low point of the separating wall. This also guarantees, for an optionally only slightly filled low-pressure chamber, for example, due to very low outside temperatures and correspondingly strongly contracting hydraulic medium, a bubble-free feeding of hydraulic medium from the low-pressure chamber into the medium-pressure chamber.

In another advantageous configuration of the invention, the housing top part should be provided with at least one ventilation opening for the low-pressure chamber opening into the cylinder head. Thus, gas bubbles that are separated from the medium-pressure chamber via the choke opening into the low-pressure chamber during the operation of the internal combustion engine continuously escape from the hydraulic unit into the interior of the cylinder head.

The reliability of a complete refilling process of the high-pressure chamber can be increased, in particular, with respect to multiple startup processes within a short time sequence by a volume ratio of the pressure chambers with $(V_L+V_M)/V_H \geqq 2$, where $V_L$ is the volume of the low-pressure chamber, $V_M$ is the volume of the medium-pressure chamber, and $V_H$ is the volume of the high-pressure chamber. In other words, the hydraulic medium reservoir available for refilling the high-pressure chamber should be at least twice as large as the high-pressure chamber, wherein this is obviously also important for those valve trains in which two slave units are connected to a single master unit for simultaneous activation of two gas-exchange valves.

In one structurally preferred configuration of the invention, the separating wall shall be formed as a housing intermediate part of the hydraulic housing assembled from the housing parts. Alternatively, however, a one-piece separating wall formed on the housing top part could also be provided, wherein then such a housing top part can be produced, for example, through internal high-pressure shaping.

In the case of the sandwich construction named above for the hydraulic housing, the housing top part should be coated with a sealing medium made from elastomeric material at least in the contact region with the housing intermediate part. The sealing medium preventing loss from the low-pressure chamber can involve either an elastomeric seal pressed or molded locally onto the sealing surface of the housing top part. Alternatively, obviously a separate seal between the housing top part and the housing intermediate part is also possible, for example, in the form of a paper seal.

In other configurations of the invention, the housing top part can be produced either in a deep-drawing method from aluminum or steel material or in an injection-molding method from plastic.

Finally, as far as possible and useful, the features and configurations of the invention named above shall also be able to be combined with each other in any desired manner.

BRIEF DESCRIPTION OF THE DRAWINGS

Additional features of the invention emerge from the following description and from the drawings in which an embodiment of the invention is shown. As far as not otherwise mentioned, here identical or functionally identical features or components are provided with identical reference symbols. Shown are.

DETAILED DESCRIPTION OF THE PREFERRED EMBODIMENTS

Figure 1:
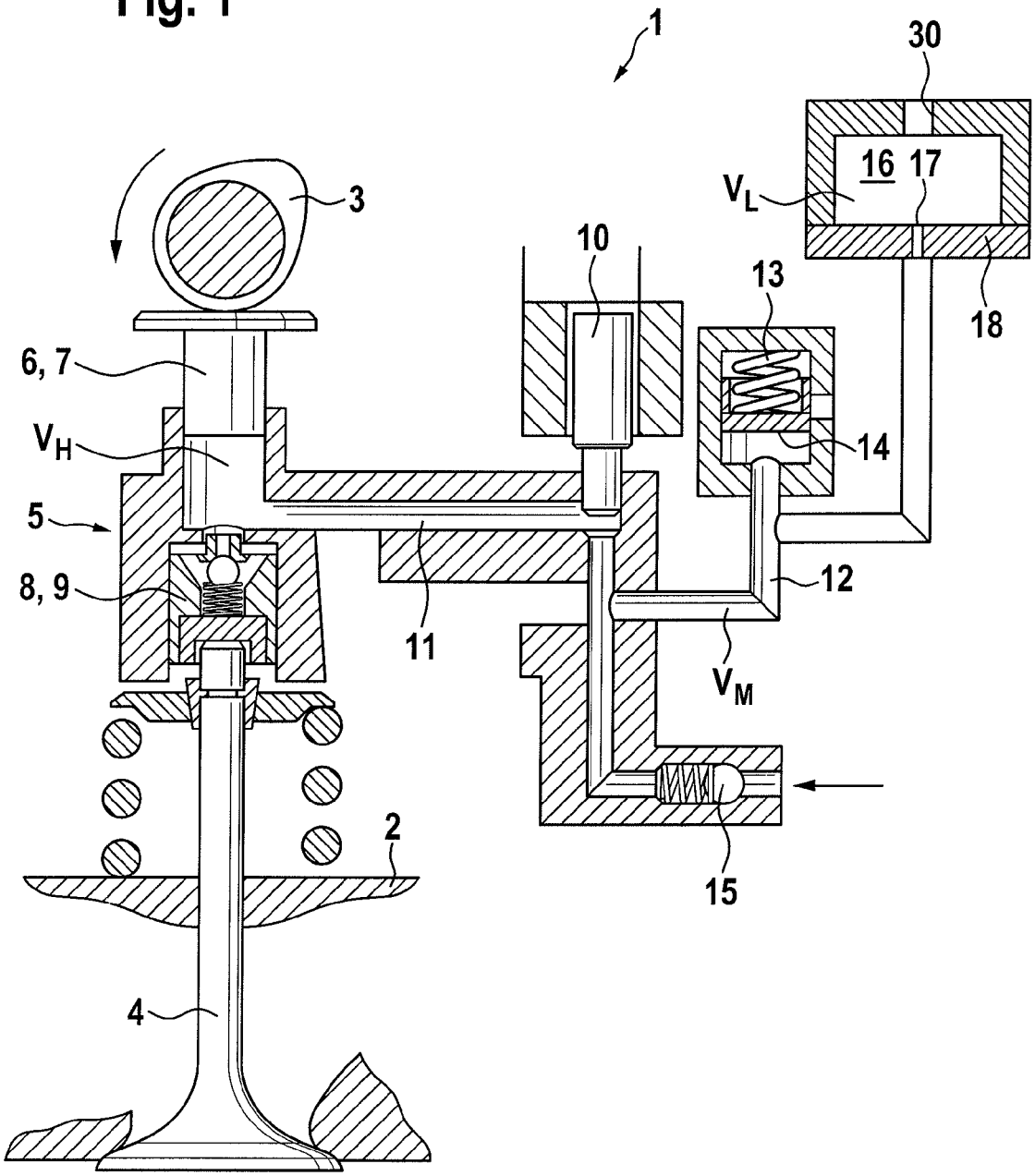
FIG. 1 is a schematic diagram of a hydraulic, variable valve train.

In FIG. 1, the basic configuration of a hydraulic, variable valve train 1 and features belonging to the invention are disclosed schematically. Shown is a cutout of a cylinder head 2 of an internal combustion engine that is essential for the understanding of the invention with a cam 3 of a camshaft and a gas-exchange valve 4 spring-loaded in the closing direction. The variability of the valve train 1 is generated by a hydraulic unit 5 that is arranged between the cam 3 and the gas-exchange valve 4 and that comprises the following components:

a drive-side master unit 6, here in the form of a pump tappet 7 driven by the cam 3, a driven-side slave unit 8, here in the form of a slave piston 9 directly activating the gas-exchange valve 4, a controllable hydraulic valve 10, here in the form of an electromagnetic 2-2 path switching valve, a high-pressure chamber 11 running between the master unit 6 and the slave unit 8 from which, for an opened hydraulic valve 10, hydraulic medium can flow into a medium-pressure chamber 12, a pressure accumulator 13 connected to the medium-pressure chamber 12 with a spring force-loaded compensation piston 14, a non-return valve 15 opening in the direction of the medium-pressure chamber 12 by which the hydraulic unit 5 is connected to the hydraulic medium circuit of the internal combustion engine, and according to the invention a low-pressure chamber 16 that is used as a hydraulic medium reservoir and that is connected to the medium-pressure chamber 12 merely by a choke opening 17 in a separating wall 18 extending between the low-pressure chamber 16 and the medium-pressure chamber 12.

The known functioning of the hydraulic valve train 1 can be summarized to the extent that the high-pressure chamber 11 acts as hydraulic links between the master unit 6 and the slave unit 8, wherein the hydraulic volume forced by the pump tappet 7 proportional to the stroke of the cam 3—while neglecting leakage—is split as a function of the opening time and the opening period of the hydraulic valve 10 into a first sub-volume charging the slave piston 9 and into a second sub-volume flowing out into the medium-pressure chamber 12 including the pressure accumulator 13. In this way, not only the control times, but also the lifting strokes of the gas-exchange valve 4 can be set completely variable.

As becomes clear in FIGS. 2 and 3 described below, the hydraulic unit 5 has a common hydraulic housing 19 as another essential component, so that the hydraulic unit 5 can be mounted into the cylinder head 2 of the internal combustion engine as a preassembled component optionally already filled with hydraulic medium. The hydraulic unit 5 constructed for a 4 cylinder in-line engine emerges in the overall view from FIG. 2. The hydraulic housing 19 assembled in a sandwich construction is made from a bottom housing part 20, the separating wall 18 formed as an intermediate housing part 21, and a housing top part 22. While the housing parts 20, 21, 22 are screwed to each other at various screw points 23 in a hydraulically sealed manner, the housing bottom part 20 has separate screw points 24 for mounting the entire hydraulic unit 5 in the cylinder head 2 of the internal combustion engine.

The four master units 6 each comprise a support element 25 held in the housing bottom part 20, a rocker arm 26 supported so that it can pivot on this support element by a rotatable roller 27 for a low-friction cam pick-up and the pump tappet 7 activated here by the rocker arm 26 and spring force-loaded in the return stroke direction. Clips 28 projecting from the housing intermediate part 21 are used as securing devices for the rocker arm 26 for a hydraulic unit 5 not mounted in the cylinder head 2. This is further constructed so that each of the master units 6 interacts with two slave units 8. In other words, for each pair of identically acting gas-exchange valves 4, i.e., intake valves or exhaust valves of a cylinder of the internal combustion engine, only one cam 3 and one master unit 6 are required, wherein the hydraulic volume displaced by the pump tappet 7 charges both slave units 8 simultaneously. On the side of the hydraulic unit 5 lying opposite the master units 6, the hydraulic valves 10 allocated to each master unit 6 and the two slave units 8 are to be seen with electrical connection plugs 29, wherein the non-energized, opened hydraulic valves 10 are mounted in valve receptacles in the housing bottom part 20 in a known way not shown here in greater detail.

Figure 2:
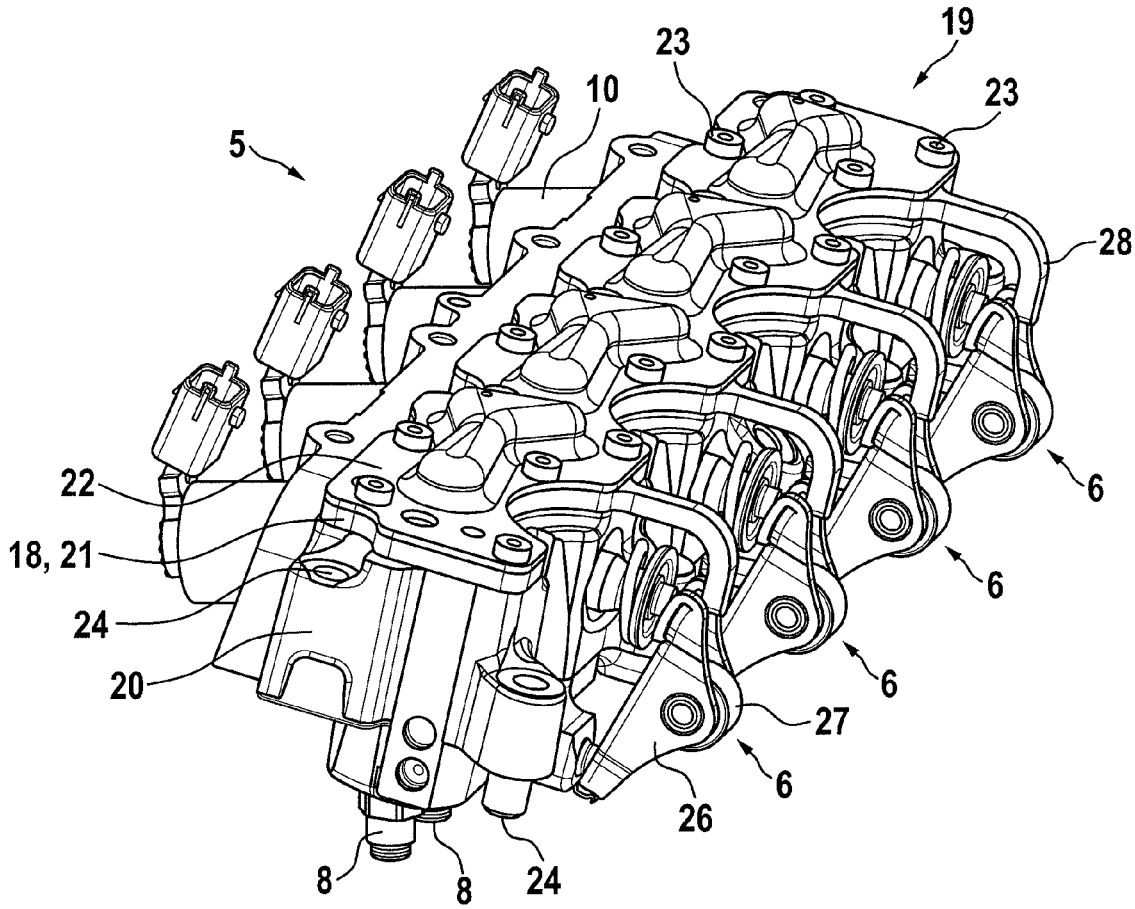
FIG. 2 is a perspective view of a hydraulic unit according to the invention.
Figure 3:
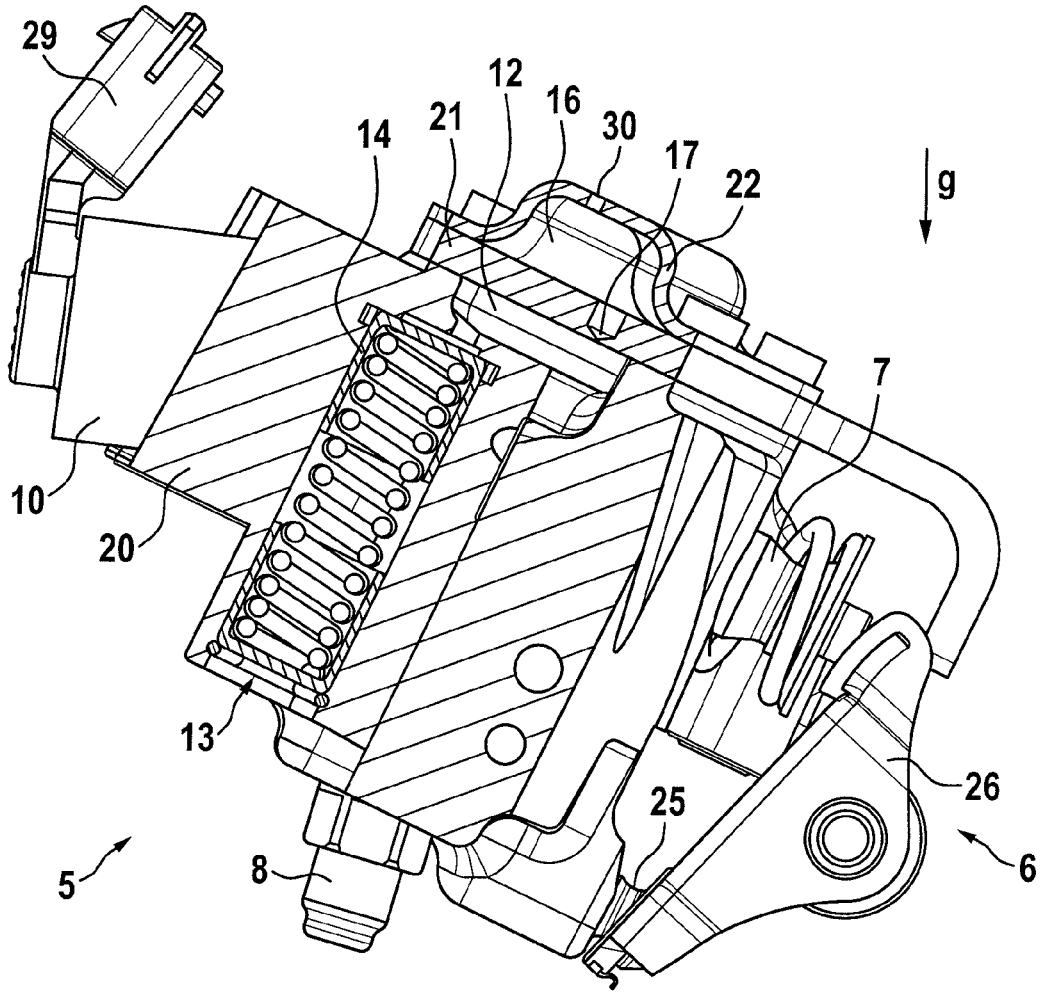
FIG. 3 is a cross sectional view through the hydraulic unit from FIG. 2.

The low-pressure chambers 16 that can already be seen in FIG. 2 with reference to the bulges in the housing top part 22 are clearly present from a cross section shown in FIG. 3 through the hydraulic unit 5. In this cross section, the pressure accumulator 13 connected to the medium-pressure chamber 12 is also shown with the spring force-loaded compensation piston 14. The choke opening 17 connecting the low-pressure chamber 16 to the medium-pressure chamber 12 is arranged so that it extends at a geodetic low point of the housing intermediate part 21 of the hydraulic unit 5 installed at an angle to the force of gravity g in and/or with the internal combustion engine. As explained above, in this way it is guaranteed that only bubble-free hydraulic medium is drawn from the low-pressure chamber 16 into the medium-pressure chamber 12. Although only one choke opening 17 is shown in FIG. 3, each of the medium-pressure chambers 12 can also communicate with the associated low-pressure chamber 16 via two or more choke openings 17. Conversely, it would also be conceivable to allocate two or more low-pressure chambers 16 separated from each other to each medium-pressure chamber 12.

Gas bubbles that reach into the low-pressure chamber 16 from the medium-pressure chamber 12 via the choke opening 17 during the operation of the internal combustion engine can be deposited into the interior of the cylinder head 2 via a ventilation opening 30 extending in the housing top part 22 and opening into the cylinder head 2.

In order to prevent a loss of hydraulic medium from the low-pressure chamber 16, in particular, during the standstill phase of the internal combustion engine, the housing top part 22 is coated with sealing medium made from elastomeric material not shown in greater detail. In the shown embodiment, this coating is not only limited to the contact region to the housing intermediate part 21, but is also located on the entire surface of the housing top part 22 produced from steel sheet metal in a deep-drawing method.

Finally, as explained with reference to an overall view with FIG. 1, the volume of the low-pressure chamber 16, designated with $V_L$, is dimensioned as large as possible, on one hand, under consideration of the available installation space in the cylinder head 2 and, on the other hand, with respect to an always sufficient hydraulic medium reservoir. This means that the volume ratio $(V_L+V_M)$ to $V_H$ has a value of at least 2, where the volume of the medium-pressure chamber 12 limited by the hydraulic valve 10, by the pressure accumulator 13, by the separating wall 18, and by the non-return valve 15 is designated with $V_M$, and the volume of the high-pressure chamber 11 limited by the master unit 6, by the slave unit or units 8, and by the hydraulic valve 10 is designated with $V_H$.

LIST OF REFERENCE SYMBOLS

1 Valve train
2 Cylinder head
3 Cam
4 Gas-exchange valve
5 Hydraulic unit
6 Master unit
7 Pump tappet
8 Slave unit
9 Slave piston
10 Hydraulic valve
11 High-pressure chamber
12 Medium-pressure chamber
13 Pressure accumulator
14 Compensation piston
15 Non-return valve
16 Low-pressure chamber
17 Choke opening
18 Separating wall
19 Hydraulic housing
20 Housing bottom part
21 Housing intermediate part
22 Housing top part
23 Screw point
24 Screw point
25 Support element
26 Rocker arm
27 Roller
28 Clip
29 Connection plug of the hydraulic valve
30 Ventilation opening

The invention claimed is:

1. Hydraulic unit for a cylinder head of an internal combustion engine with a hydraulic, variable valve train, comprising:

at least one drive-side master unit, at least one driven-side slave unit activating a gas-exchange valve, at least one controllable hydraulic valve, at least one medium-pressure chamber, at least one high-pressure chamber that is arranged in a transmission sense between an associated one of the at least one drive-side master unit and an associated one of the at least one driven-side slave unit and that can be connected to an associated one of the at least one medium-pressure chamber via an associated one of the at least one hydraulic valve, and a hydraulic housing with a housing bottom part and a housing top part, wherein at least the at least one master unit, the at least one slave unit, the at least one high-pressure chamber, the at least one hydraulic valve, and the at least one medium-pressure chamber in connection with the hydraulic housing belong to the hydraulic unit that can be mounted on the cylinder head, and a low-pressure chamber used as a hydraulic medium reservoir is formed in a housing top part, the low-pressure chamber communicates with the at least one medium-pressure chamber merely via at least one choke opening, and the choke opening passes through a separating wall extending between the at least one low-pressure chamber and the at least one medium-pressure chamber.

2. Hydraulic unit according to claim 1, wherein the choke opening extends at a geodetic low point of the separating wall for the case that the hydraulic unit is installed at an angle to a force of gravity in or with the internal combustion engine.

3. Hydraulic unit according to claim 1, wherein the housing top part is provided with at least one ventilation opening opening into the cylinder head for the low-pressure chamber.

4. Hydraulic unit according to claim 1, wherein the at least one low-pressure chamber has a volume $V_L$, the at least one medium-pressure chamber has a volume $V_M$, and the at least one high-pressure chamber has a volume $V_H$ with a volume ratio $(V_L+V_M)/V_H \geqq 2$.

5. Hydraulic unit according to claim 1, wherein the separating wall is formed as a housing intermediate part of the hydraulic housing assembled with a sandwich construction from the housing bottom, intermediate and top parts.

6. Hydraulic unit according to claim 5, wherein the housing top part is coated with a sealing medium made from an elastomeric material at least in a region of contact with the housing intermediate part.

7. Hydraulic unit according to claim 1, wherein the housing top part is a deep drawn aluminum or steel part.

8. Hydraulic unit according to claim 1, wherein the housing top part is an injection molded plastic part.

* * * * *